US012685399B2

(12) United States Patent
Lu

(10) Patent No.: US 12,685,399 B2
(45) Date of Patent: Jul. 21, 2026

(54) WALL MOUNTING BRACKET AND WALL MOUNTING DEVICE

(71) Applicant: Jiayi Lu, Shenzhen (CN)

(72) Inventor: Jiayi Lu, Shenzhen (CN)

( * ) Notice: Subject to any disclaimer, the term of this patent is extended or adjusted under 35 U.S.C. 154(b) by 39 days.

(21) Appl. No.: 18/991,247

(22) Filed: Dec. 20, 2024

(65) Prior Publication Data

US 2026/0137221 A1 May 21, 2026

(30) Foreign Application Priority Data

Nov. 15, 2024 (CN) ..... 202422790944.5

(51) Int. Cl.
*A47G 1/20* (2006.01)
*A47G 1/16* (2006.01)

(52) U.S. Cl.
CPC ..... *A47G 1/164* (2013.01)

(58) Field of Classification Search
CPC ..... A47G 1/164
See application file for complete search history.

(56) References Cited

U.S. PATENT DOCUMENTS

| | | | | |
|---|---|---|---|---|
| 545,774 | A * | 9/1895 | Clark | F16L 3/14 248/59 |
| 2,975,994 | A * | 3/1961 | Goss | A47G 1/1626 248/478 |
| 10,070,740 | B2 * | 9/2018 | Jacobs | F16M 13/02 |
| 2007/0023605 | A1 * | 2/2007 | Schlais | A47G 1/205 248/489 |
| 2018/0289179 | A1 * | 10/2018 | Fastermann | A47G 29/00 |

* cited by examiner

*Primary Examiner* — Amy J. Sterling
(74) *Attorney, Agent, or Firm* — HOWARD M COHN and Associates, LLC

(57) ABSTRACT

A wall mounting bracket and a wall mounting device are provided. The wall mounting bracket includes a fixing component, an adjusting component, a mounting component, and at least one locking component. A first guiding groove is defined on the fixing component, a first side of the fixing component facing away from the first guiding groove is fixed to a mounting surface. The adjusting component is disposed in the first guiding groove and is slidable in the first guiding groove along a first direction. Positioning grooves extending in the first direction are defined on at least one side of the adjusting component along the first direction. The mounting component is connected to the adjusting component and is configured to mount a product. The wall mounting bracket enables an easier and more efficient mounting process.

20 Claims, 5 Drawing Sheets

WALL MOUNTING BRACKET AND WALL MOUNTING DEVICE

TECHNICAL FIELD

The present disclosure relates to a technical field of wall mounting devices, and in particular to a wall mounting bracket and a wall mounting device.

BACKGROUND

During a process of home renovation, many people like to hang several pieces of artwork at home, and for ensuring aesthetics, a picture frame must be kept level when hanging on a wall.

However, wall mounting brackets of current picture frames typically rely on short nails to fix to a corresponding wall. Once each wall mounting bracket is fixed, adjusting a position of a corresponding picture frame becomes difficult. Therefore, if one picture frame tilts, detaching a corresponding wall mounting bracket is required for correction, followed by remeasurement and reinstallation, which makes an entire process thereof quite cumbersome and inconvenient.

SUMMARY

Embodiments of the present disclosure provide a wall mounting bracket and a wall mounting device that enable easier and more efficient mounting process of the wall mounting bracket.

In a first aspect, the embodiments of the present disclosure provide the wall mounting bracket, including a fixing component, an adjusting component, a mounting component, and at least one locking component. A first guiding groove is defined on the fixing component, a first side of the fixing component facing away from the first guiding groove is fixed to a mounting surface. The adjusting component is disposed in the first guiding groove and is slidable in the first guiding groove along a first direction. Positioning grooves extending in the first direction are defined on at least one side of the adjusting component along the first direction. The mounting component is connected to the adjusting component and is configured to mount a product. At least one positioning protrusion extending in the first direction is disposed on one side of the at least one locking component, the at least one locking component is movably connected to the fixing component and has a locking state and unlocking state. A limiting opening is defined on at least one groove side wall of the first guiding groove. When the at least one locking component is in the unlocking state, the adjusting component is slidable in the first guiding groove, when the at least one locking component is in the locking state, the at least one positioning protrusion passes through the limiting opening on the at least one groove side wall of the first guiding groove and is inserted into at least one of the positioning grooves to fix the adjusting component in the first guiding groove.

In some embodiments, positioning protrusions are provided and are spaced apart along the first direction.

In some embodiments, the at least one locking component includes a rotating connection portion and a locking portion, the rotating connection portion is connected to the locking portion, the rotating connection portion is rotatably connected to the fixing component, the at least one positioning protrusion is disposed on the locking portion. When the at least one locking component is in the locking state, the at least one locking component is snap-fitted to the fixing component.

In some embodiments, the fixing component includes a base plate, a first limiting structure, and a second limiting structure, the first limiting structure and the second limiting structure protrude from the base plate and are space apart in a direction perpendicular to the first direction. The first limiting structure, the second limiting structure, and the base plate cooperatively define the first guiding groove. One locking component is provided, one side of the first limiting structure facing away from the first guiding groove and the base plate cooperatively define a limiting groove, the limiting opening is defined on a middle portion of the first limiting structure, and the limiting opening is communicated with the first guiding groove and the limiting groove. When the one locking component is in the locking state, the one locking component is disposed in the limiting groove.

In some embodiments, the first limiting structure includes a first connecting portion and a first limiting portion, the first connecting portion is connected to the base plate, the first limiting portion is connected to one end of the first connecting portion away from the base plate and is disposed at a first angle with the first connecting portion. The first limiting portion, the first connecting portion, and the base plate cooperatively define a first clamping groove, the first clamping groove is communicated with the first guiding groove. The second limiting structure includes a second connecting portion and a second limiting portion, the second connecting portion is connected to the base plate, the second limiting portion is connected to one end of the second connecting portion away from the base plate and is disposed at a second angle with second connecting portion. The second limiting portion, the second connecting portion, and the base plate cooperatively define a second clamping groove, the second clamping groove is communicated with the first guiding groove. Two third limiting portions are respectively disposed at two opposite sides of the adjusting component, and the two third limiting portions are respectively slidably inserted into the first clamping groove and the second clamping groove.

In some embodiments, a rotating connection portion is rotatably connected to a bottom wall of the fixing component, the first limiting portion includes a clamping protrusion in the limiting opening, the locking portion defines a third clamping groove at one end thereof away from the rotating connection portion for the clamping protrusion to insert into.

In some embodiments, a grasping groove is defined on the locking portion.

In some embodiments, identifiers are disposed on the adjusting component corresponding to the positioning grooves.

In some embodiments, a second guiding groove is defined on the adjusting component, the mounting component is disposed in the second guiding groove, the mounting component is slidable in the second guiding groove along a second direction, and the mounting component is fixed relative to the adjusting component after sliding. The first direction is a horizontal direction, the second direction is a vertical direction, or, the first direction is the vertical direction, the second direction is the horizontal direction.

In some embodiments, the first direction is the vertical direction, and the second direction is the horizontal direction.

In some embodiments, the mounting component includes a fixing portion and a mounting portion. The fixing portion is disposed on a rear surface of the adjusting component. The mounting portion is connected to a second side of the fixing component and passes through the second guiding groove to extend toward a front surface of the adjusting component.

In some embodiments, in a thickness direction of the adjusting component, the second guiding groove includes a first groove body and a second groove body, the first groove body is communicated with the second groove body. A size of the second groove body is larger than a size of the first groove body, the fixing portion is slidable in the second groove body, and the mounting portion is slidable in the first groove body.

In some embodiment, the fixing portion is plate-shaped, and a groove depth of the second groove body is adapted to a thickness of the fixing portion.

In some embodiments, the fixing portion defines at least one concave groove, the adjusting component includes at least one protruding rib disposed in the second groove body, the at least one protruding rib is clamped in the at least one concave groove.

In some embodiments, the adjusting component includes a first plate body and a second plate body, the first plate body and the second plate body are stacked, the first groove body is defined on the first plate body, the second groove body is defined on the second plate body, and the at least one protruding rib is further disposed on the second plate body.

In some embodiments, two protruding ribs are provided and disposed at two opposite sides of the first groove body in the second direction.

In some embodiments, at least one mounting hole is defined on the fixing component, at least one fastening component passes through the at least one mounting hole and is fixed to the mounting surface, so as to fix the fixing component on the mounting surface; and/or, the wall mounting bracket further includes a double-sided adhesive layer disposed on a rear surface of the fixing component, the double-sided adhesive is configured to bond the fixing component to the mounting surface.

In a second aspect, the embodiments of the present disclosure further provide the wall mounting device, including the wall mounting bracket as foregoing and an assembly bracket. The assembly bracket is detachably disposed on the mounting component, the assembly bracket defines a mounting groove, and the mounting groove is configured to mount a level.

In some embodiments, the mounting component includes the fixing portion and the mounting portion. The mounting portion includes a mounting segment and a limiting segment, the mounting segment is connected to the second side of the fixing portion, the limiting segment is connected to one end of the mounting segment away from the fixing portion and is disposed at an angle with the mounting segment. The assembly bracket includes a bracket main body and an assembly portion, the assembly portion is connected to the bracket main body, the mounting groove is defined on the bracket main body, the assembly portion defines a fourth clamping groove for the mounting segment to insert into.

In some embodiments, the bracket main body includes a mounting plate and two limiting baffles at two sides thereof, the two limiting baffles are respectively connected a top portion of the mounting plate, each of the two limiting baffles includes an end plate and two side plates, each two side plates are respectively disposed at a first side and a second side of a corresponding end plate and extend outward from a third side of the corresponding end plate. Each two side plates are disposed opposite to each other, so as to cooperatively define the mounting groove with the mounting plate.

According to the wall mounting bracket and the wall mounting device of the embodiments of the present disclosure, the positioning grooves on the adjusting component allow the at least one positioning protrusion of the at least one locking component to be inserted at different positions, thereby accurately positioning the adjusting component in the first guiding groove. After the at least one positioning protrusion is inserted into the at least one of the positioning grooves, the adjusting component is fixed relative to the fixing component, thereby ensuring stability of mounting the product. Specifically, the positioning protrusions are provided and are spaced apart in the first direction, in this way, a contact area between the positioning protrusions and the positioning grooves are increased, thereby improving fixation stability of the adjusting component 200. In the present disclosure, users may release limitation on the adjusting component in the first guiding groove by switching the at least one locking component from the locking state to the unlocking state. Once the at least one locking component is unlocked, the adjusting component freely slides in the first guiding groove, allowing the users to easily adjust a height or a horizontal distance of the product. After adjusting the product to a desired state, the users only need to switch the at least one locking component back to the locking state, which reinserts the at least one positioning protrusion into the at least one of the positioning grooves to fix the adjusting component relative the fixing component. A mounting process of the wall mounting bracket is simple and ensures high stability.

BRIEF DESCRIPTION OF DRAWINGS

In order to more clearly illustrate embodiments of the present disclosure or technical solutions in the prior art, accompanying drawings required in description of the embodiments or the prior art are briefly described below, and obviously, the accompanying drawings in the following description are merely some embodiments of the present disclosure, and for those who skilled in the art, other drawings may be obtained according to structures shown in these drawings without creative efforts.

Figure 1:
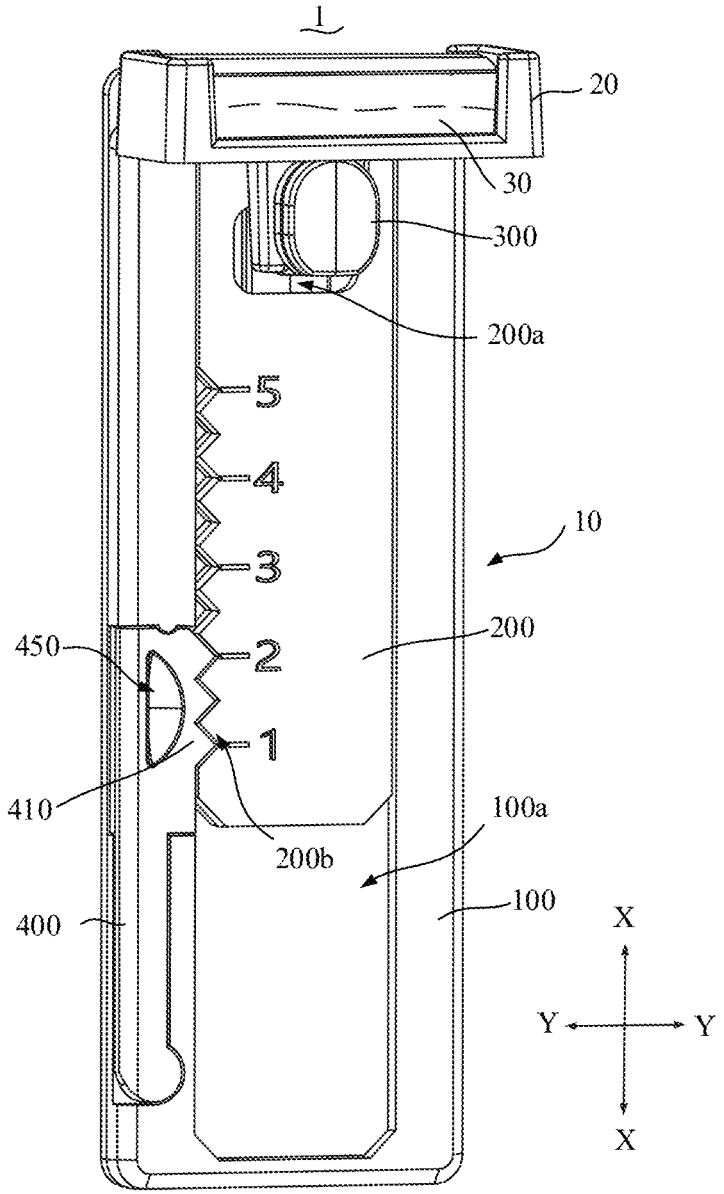
FIG. 1 is a structural schematic diagram of a wall mounting device according to one embodiment of the present disclosure.

Reference numerals in the drawings: 1. wall mounting device; 10. wall mounting bracket; 100. fixing component;

100*a*. first guiding groove; 100*b*. limiting opening; 100*c*. limiting groove; 100*d*. mounting hole; 110. base plate; 120. first limiting structure; 120*a*. first clamping groove; 121. first connecting portion; 122. first limiting portion; 130. second limiting structure; 130*a*. second clamping groove; 131. second connecting portion; 132. second limiting portion; 140. clamping protrusion; 200. adjusting component; 200*a*. second guiding groove; 200*a*1. first groove body; 200*a*2. second groove body; 200*b*. positioning groove; 210. third limiting portion; 220. protruding rib; 230. first plate body; 240. second plate body; 300. mounting component; 310. fixing portion; 310*a*. concave groove; 320. mounting portion; 321, mounting segment; 322. limiting segment; 400. locking component; 410. positioning protrusion; 420. rotating connection portion; 430. locking portion; 440. third clamping groove; 450. grasping groove; 20. assembly bracket; 20*a*. mounting groove; 21. bracket main body; 211. mounting plate; 212. limiting baffle; 2121. end plate; 2122. side plate; 220. assembly portion; 22*a*. fourth clamping groove; 30. level; X-X. first direction; Y-Y. second direction.

Implementations, functional features, and advantages of the present disclosure are further described with reference to the accompanying drawings in combination with the embodiments.

DETAILED DESCRIPTION OF EMBODIMENTS

In order to better understand technical solutions of the present disclosure, embodiments of the present disclosure are described in detail below with reference to accompanying drawings.

When following description refers to the accompanying drawings, unless otherwise indicated, the same numbers in different drawings represent the same or similar elements. Implementations described in following exemplary embodiments do not represent all implementations consistent with this application. Instead, they are merely examples of apparatuses and methods consistent with some aspects of the present disclosure as recited in appended claims.

In the description of the present disclosure, it should be understood that terms "first", "second", etc. are only used for descriptive purposes, and cannot be understood as indicating or implying relative importance. Those who skilled in the art would understand specific meanings of the foregoing terms in the present disclosure according to specific situations. In addition, in the description of the present disclosure, unless otherwise stated, "a plurality of" means two or more, "and/or" used herein is merely an association relationship describing associated objects. For example, A and/or B may indicate three cases that A exists alone, A and B exist, and B exists alone, and a character "/" in the specification generally indicates an "or" relationship between the associated objects Unless otherwise defined, all technical and scientific terms used herein have the same meaning as commonly understood by those who skilled in the art to which the present disclosure belongs. The terms used in the specification are only for the purpose of describing specific embodiments, and are not intended to limit the present disclosure. As used herein, the term "and/or" includes any and all combinations of one or more of associated listed items.

Please refer to FIG. 1, embodiments of the present disclosure provide a wall mounting bracket 10, including a fixing component 100, an adjusting component 200, a mounting component 300, and at least one locking component 400. A first guiding groove 100*a* is defined on the fixing component 100, a first side of the fixing component 100 facing away from the first guiding groove 100*a* is fixed to a mounting surface, the mounting surface is selected from a wall, a door, a blackboard, etc. At least one mounting hole 100*d* is defined on the fixing component 100, at least one fastening component passes through the at least one mounting hole 100*d* and is fixed to the mounting surface, so as to fix the fixing component 100 on the mounting surface. Specifically, two mounting holes 100*d* are provided and are disposed on a top portion of the fixing component 100, the at least one fastening component is selected from a nail, a screw, etc., so as to securely fix the fixing component 100 on the mounting surface.

In some embodiments, the wall mounting bracket 10 further includes a double-sided adhesive layer disposed on a rear surface of the fixing component 100, the double-sided adhesive is configured to bond the fixing component 100 to the mounting surface. The double-sided adhesive layer and the at least one mounting hole 100*d* are provided alternatives or in combination. In a solution that the fixing component 100 includes the double-sided adhesive layer and the at least one mounting hole 100*d* at the same time, the double-sided adhesive layer serves as an initial fixation method, ensuring that the fixing component 100 is first accurately adhered to the mounting surface, and then the fixing component 100 is fixed on the mounting surface through the fastening component, so that fixing stability and fixing effect of the wall mounting bracket 10 are improved.

The adjusting component 200 is disposed in the first guiding groove 100*a* and is slidable in the first guiding groove 100*a* along a first direction X-X. The mounting component 300 is connected to the adjusting component 200 and is configured to mount a product, specifically, the product is selected from a painting, a decorative item, etc. Positioning grooves 200*b* extending in the first direction X-X are defined on at least one side of the adjusting component 200 along the first direction X-X, and a limiting opening 100*b* is defined on at least one groove side wall of the first guiding groove 100*a*. At least one positioning protrusion 410 extending in the first direction X-X is disposed on one side of the at least one locking component 400, the at least one locking component 400 is movably connected to the fixing component 100 and has a locking state and unlocking state. When the at least one locking component 400 is in the unlocking state, the adjusting component 200 is slidable in the first guiding groove 100*a*, when the at least one locking component 400 is in the locking state, the at least one positioning protrusion 410 passes through the limiting opening 100*b* on the at least one groove side wall of the first guiding groove 100*a* and is inserted into at least one of the positioning grooves 200*b* to fix the adjusting component 200 relative to the fixing component 100.

The positioning grooves 200*b* on the adjusting component 200 allow the at least one positioning protrusion 410 of the at least one locking component 400 to be inserted at different positions, thereby accurately positioning the adjusting component 200 in the first guiding groove 100*a*. After the at least one positioning protrusion 410 is inserted into the at least one of the positioning grooves 200*b*, the adjusting component 200 is fixed relative to the fixing component 100, thereby ensuring stability of mounting the product. Specifically, the positioning protrusions 410 are provided and are spaced apart in the first direction X-X, in this way, a contact area between the positioning protrusions 410 and the positioning grooves 200*b* are increased, thereby improving fixation stability of the adjusting component 200. In the present disclosure, users may release limitation on the adjusting component 200 in the first guiding groove 100*a* by switching the at least one locking component 400 from the locking state to the unlocking state. Once the at least one locking component 400 is unlocked, the adjusting component 200 freely slides in the first guiding groove 100*a*, allowing the users to easily adjust a height or a horizontal distance of the product. After adjusting the product to a desired state, the users only need to switch the at least one locking component 400 back to the locking state, which reinserts the at least one positioning protrusion 410 into the at least one of the positioning grooves 200*b* to fix the adjusting component 200 relative the fixing component 100.

It may be understood that, when one locking component 400 is provided, the limiting opening 100*b* is defined on one groove side wall of the first guiding groove 100*a*, and the at least one positioning protrusion 410 of the one locking component 400 passes through the limiting opening 100*b* and is fixed to the at least one of the positioning grooves 200*b*. When two locking components 400 are provided, two limiting openings 100*b* are respectively defined at two groove side walls of the first guiding groove 100*a*, the two locking components 400 are respectively disposed at two sides of the first guiding groove 100*a*, and at least two positioning protrusions 410 are respectively disposed on the two locking components 400, the at least two positioning protrusions 410 respectively pass through the two limiting openings 100*b* respectively defined at the two groove side walls of the first guiding groove 100*a* and are fixed to the positioning grooves 200*b* that respectively defined on two sides of the adjusting component 200.

Figure 3:
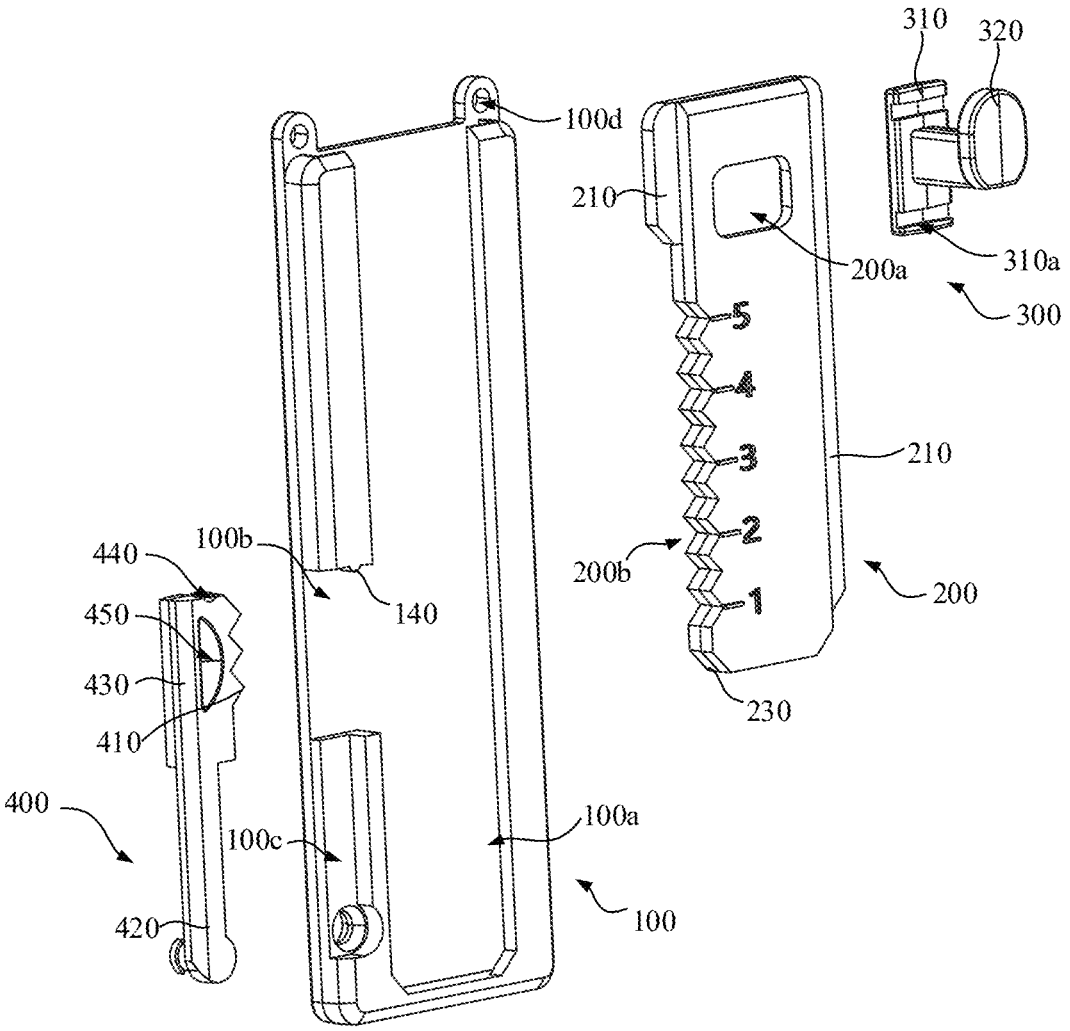
FIG. 3 is an exploded schematic diagram of the wall mounting bracket according to one embodiment of the present disclosure.

Please refer to FIG. 3, in some embodiments, the at least one locking component 400 includes a rotating connection portion 420 and a locking portion 430, the rotating connection portion 420 is connected to the locking portion 430, the rotating connection portion 420 is rotatably connected to the fixing component 100, the at least one positioning protrusion 410 is disposed on the locking portion 430. When the at least one locking component 400 is in the locking state, the at least one locking component 400 is snap-fitted to the fixing component 100. In this way, the locking state and the unlocking state of the at least one locking component 400 is switched by a simple rotation action, which is simple and convenient, does not need additional tools or complex steps, and further prevents the at least one locking component 400 from losing. When the at least one locking component 400 is in the locking state, a snap connection is formed between the locking portion 430 and the fixing portion 100 to fix the adjusting component 200 in the first guiding groove 100*a*, thereby preventing accidental sliding or falling caused by an external force. In other embodiments, when the at least one locking component 400 is in the unlocking state, the at least one locking component 400 is completely detached from the fixing portion 100, and when the at least one locking component 400 is in the locking state, the at least one locking component 400 is fixedly connected to the fixing portion 100 in a fastening manner, a screw fixing connection manner, etc.

Figure 4:
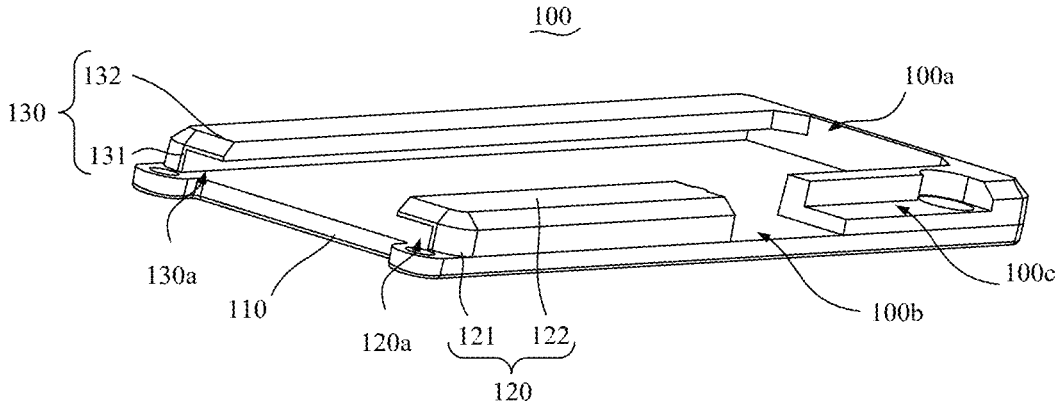
FIG. 4 is a structural schematic diagram of a fixing component according to one embodiment of the present disclosure.

Please refer to FIG. 4, in some embodiments, the fixing portion 310 is plate-shaped and includes a base plate 110, a first limiting structure 120, and a second limiting structure 130, the first limiting structure 120 and the second limiting structure 130 protrude from the base plate 110 and are space apart in a second direction Y-Y. The first limiting structure 120, the second limiting structure 130, and the base plate 110 cooperatively define the first guiding groove 100*a*. One locking component 400 is provided, one side of the first limiting structure 120 facing away from the first guiding groove 100*a* and the base plate 110 cooperatively define a limiting groove 100*c*, the limiting opening 100*b* is defined on a middle portion of the first limiting structure 120, and the limiting opening 100*b* is communicated with the first guiding groove 100*a* and the limiting groove 100*c*. When the one locking component 400 is in the locking state, the one locking component 400 is disposed in the limiting groove 100*c*. In the present disclosure, the first limiting structure 120, the second limiting structure 130, and the base plate 110 cooperatively define the first guiding groove 100*a*, which is simple in structure and convenient to process. When the at least one locking component is in the locking state, the at least one locking component 400 is skillfully hidden in the limiting groove 100*c*, thereby avoiding exposing to the outside, in this, a space occupied by the wall mounting bracket 10 is reduced and improving aesthetics of the wall mounting bracket 10 is further enhanced.

Please refer to FIG. 4, in some embodiments, the first limiting structure 120 includes a first connecting portion 121 and a first limiting portion 122, the first connecting portion 121 is connected to the base plate 110, the first limiting portion 122 is connected to one end of the first connecting portion 121 away from the base plate 110 and is disposed at a first angle with the first connecting portion 121. The first limiting portion 122, the first connecting portion 121, and the base plate 110 cooperatively define a first clamping groove 120*a*, the first clamping groove 120*a* is communicated with the first guiding groove 100*a*. The second limiting structure 130 includes a second connecting portion 131 and a second limiting portion 132, the second connecting portion 131 is connected to the base plate 110, the second limiting portion 132 is connected to one end of the second connecting portion 131 away from the base plate 110 and is disposed at a second angle with second connecting portion 131. The second limiting portion 132, the second connecting portion 131, and the base plate 110 cooperatively define a second clamping groove 130*a*, the second clamping groove 130*a* is communicated with the first guiding groove 100*a*. Two third limiting portions 210 are respectively disposed at two opposite sides of the adjusting component 200, and the two third limiting portions 210 are respectively slidably inserted into the first clamping groove 120*a* and the second clamping groove 130*a*.

Please refer to FIG. 3, furthermore, a rotating connection portion 420 is rotatably connected to a bottom wall of the fixing component 100, the first limiting portion 122 includes a clamping protrusion 140 in the limiting opening 100*b*, the locking portion 430 defines a third clamping groove 440 at one end thereof away from the rotating connection portion 420 for the clamping protrusion 140 to insert into. In this way, when the at least one locking component 400 in the locking state, opposite sides of the at least one locking component 400 are limited, thereby improving stability of fixing the adjusting component 200 by the at least one locking component 400.

In the embodiment, the first limiting structure 120 and the second limiting structure 130 cooperate with the base plate 110 to define the first clamping groove 120*a* and the second clamping groove 130*a*, and the two third limiting portions 210 disposed on the adjusting component 200 are respectively in sliding fit with the first clamping groove 120*a* and the second clamping groove 130*a*, which not only limits movement of the adjusting component 200 in the first guiding groove 100*a*, but also prevents the adjusting component 200 from being separated from the first guiding groove 100*a* through a front side of the wall mounting bracket 10 due to a guiding effect of clamping grooves. Alternatively, the adjusting component 200 defines corresponding clamping grooves, and each limiting structure includes a limiting portion, so as to prevent the adjusting component 200 from being separated from the first guiding groove 100*a* through a front side of the wall mounting bracket 1.

Please refer to FIG. 3, furthermore, the positioning grooves 200*b* are defined on one side of the adjusting component 200, one of the two third limiting portions 210 that disposed at the one side of the adjusting component 200 where the positioning grooves 200*b* are defined is disposed above the positioning grooves 200*b*, correspondingly, the first clamping groove 120*a* is defined on an upper portion of the first guiding groove 100*a* of the fixing component 100. For example, in a vertical direction, the first clamping groove 120*a* is defined at a top portion of the limiting opening 100*b*, and a portion of the first limiting structure 120 that disposed at a bottom portion of the limiting opening 100*b* may only include a limiting plate. In this way, the limiting groove 100*c* is formed by effectively using a space in a lower portion of the fixing component 100, enabling a more compact structure.

Please refer to FIG. 3, in order to facilitate the users to control the locking portion 430, a grasping groove 450 is defined on the locking portion 430. In this way, the users may more easily grasp the locking portion 430, thereby conveniently switching the locking member 40 between the locking state and the unlocking state. In order to facilitate the users to adjust a height of the mounting component 300, identifiers are disposed on the adjusting component 200 corresponding to the positioning grooves 200*b*.

In some embodiments, a second guiding groove 200*a* is defined on the adjusting component 200, the mounting component 300 is disposed in the second guiding groove 200*a*, the mounting component 300 is slidable in the second guiding groove 200*a* along a second direction, and the mounting component 300 is fixed relative to the adjusting component 200 after sliding. The first direction X-X is a horizontal direction, the second direction Y-Y is a vertical direction, or, the first direction X-X is the vertical direction, the second direction Y-Y is the horizontal direction. In this way, after the mounting component 300 is horizontally adjusted to a desired position, the mounting component 300 may be relatively fixed by relying solely on static friction between the mounting component 300 and the adjusting component 200, along with a weight of the product mounted thereon, which eliminates a need for a special fixing device, thereby simplifying a structure of the wall mounting bracket 10.

According to the wall mounting bracket 10 of the embodiments of the present disclosure, through the first guiding groove 100*a* and the second guiding groove 200*a*, the mounting component 300 moves in the first direction X-X along with the adjusting component 200 sliding in the first guiding groove 100*a*, and the mounting member 300 is also slidable in the second guiding groove 200*a* and movable in the second direction Y-Y, specifically, the first direction X-X is the horizontal direction, the second direction Y-Y is the vertical direction, or, the first direction X-X is the vertical direction, the second direction Y-Y is the horizontal direction. For example, the first direction X-X is the vertical direction, the second direction Y-Y is the horizontal direction. In this way, the mounting component 300 is capable of flexibly adjusting a height distance and a horizontal distance of the product mounted thereon. Taking the product as the painting as an example, at least two wall mounting brackets 10 are usually required for mounting the painting, and the two wall mounting brackets 10 are respectively fixed at two ends of the painting, and in order to ensure a representation angle of the painting, the two wall mounting brackets 10 need to be located on the same horizontal line. The mounting component 300 of the wall mounting bracket 10 in the present disclosure enables fine adjustments in both the vertical direction and the horizontal direction to meet above requirements.

Please refer to FIG. 3, in some embodiments, the mounting component 300 includes a fixing portion 310 and a mounting portion 320. The fixing portion 310 is disposed on a rear surface of the adjusting component 200. The mounting portion 320 is connected to a second side of the fixing component 100 and passes through the second guiding groove 200*a* to extend toward a front surface of the adjusting component 200. Specifically, the adjusting component 200 is fixed in the first guiding groove 100*a*, with the fixing portion 310 disposed on the rear surface of the adjusting component 200 positioned between the adjusting component 200 and the fixing component 100, which relatively fixes the mounting component 300 in a front-to-back direction. The mounting portion 320 passes through the second guiding groove 200*a* and is slidable in the second guiding groove 200*a*, in this way, the second guiding groves 200*a* limits the mounting component 300 in the vertical direction.

Figure 5:
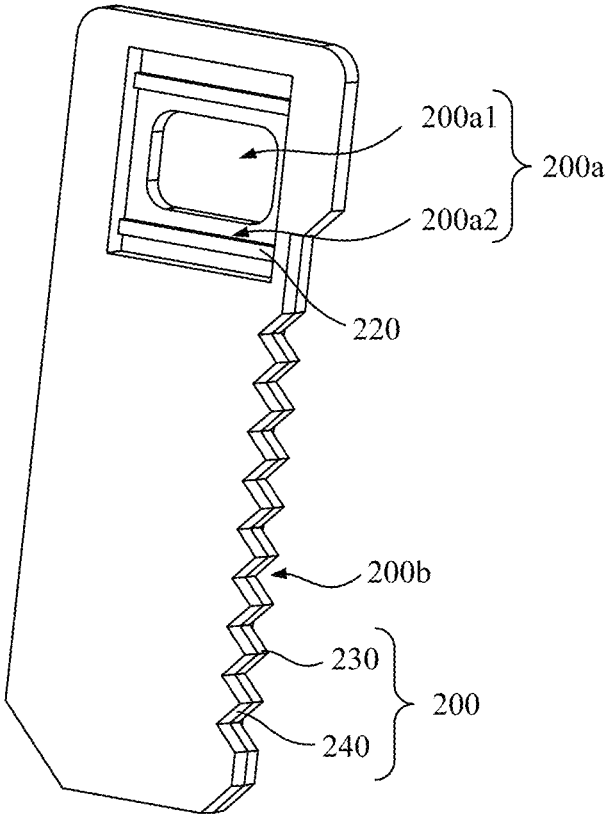
FIG. 5 is a structural schematic diagram of an adjusting component according to one embodiment of the present disclosure.

Please refer to FIG. 5, in a thickness direction of the adjusting component 200, the second guiding groove 200*a* includes a first groove body 200*a*1 and a second groove body 200*a*2, the first groove body 200*a*1 is communicated with the second groove body 200*a*2. A size of the second groove body 200*a*2 is larger than a size of the first groove body 200*a*1, the fixing portion 310 is slidable in the second groove body 200*a*2, and the mounting portion 320 is slidable in the first groove body 200*a*1. In some embodiments, the fixing portion 310 is plate-shaped, and a groove depth of the second groove body 200*a*2 is adapted to a thickness of the fixing portion 310. In the present disclosure, the fixing portion 310 is accommodated in the second groove body 200*a*2, and at this time, the rear surface of the adjusting component 200 is in close contact with a groove bottom wall of the first guiding groove 100*a*, so that sliding stability of the adjusting component 200 in the first guiding groove 100*a* is improved. Moreover, the fixing portion 310 increases a contact area between the mounting component 300 and the adjusting component 200, thereby enhancing mounting stability of the mounting component 300 on the adjusting component 200, so that the mounting component 300 is prevented from shaking or falling off due to an overly heavy product mounted therein or the external force.

The fixing portion 310 defines at least one concave groove 310*a*, the adjusting component 200 includes at least one protruding rib 220 disposed in the second groove body 200*a*2, the at least one protruding rib 220 is clamped in the at least one concave groove 310*a*. The at least one protruding rib 220 is configured to guide the fixing portion 310, so that the fixing portion 310 linearly moves when sliding in the second groove body 200*a*2, thereby reducing deviation or shaking that may occur in a sliding process of the fixing portion 310, and further improving stability of the mounting portion 320 when the product is mounted on the mounting portion 320.

Please refer to FIG. 5, the adjusting component 200 includes a first plate body 230 and a second plate body 240, the first plate body 230 and the second plate body 240 are stacked, the first groove body 200*a*1 is defined on the first plate body 230, the second groove body 200*a*2 is defined on the second plate body 240, and the at least one protruding rib 220 is further disposed on the second plate body 240. The first groove body 200*a*1 is manufactured on the first plate body 230 through simple stamping, cutting processes, or injection molding production. Similarly, the second groove body 200*a*2 and the at least one protruding rib 220 are manufactured on the second plate body 240 through the simple stamping, the cutting processes, or the injection molding. Afterwards, the first plate body 230 and the second plate body 240 are fixed as a single unit through welding, bolted connections, or the injection molding. This manufacturing approach is straightforward and provides a structure with high strength. Alternatively, the adjusting component 200 is a single integrated component, with the first groove body 200*a*1, the second groove body 200*a*2, and the at least one protruding rib 220 220 all machined directly into the single integrated component. Furthermore, the second plate body 240 is also formed to include the two third limiting portions 210. A specific form of the adjusting component 200 is not limited herein.

Please refer to FIG. 5, furthermore, two protruding rib 220*s* are provided and disposed at two opposite sides of the first groove body 200*a*1 in the second direction Y-Y. In this way, not only is linear motion accuracy of the fixing portion 310 further improved, but structural rigidity of the adjusting piece 200 is also enhanced. The adjusting component 200 is capable of resisting external stresses and loads, thereby improving stability and durability of the wall mounting bracket 10.

Figure 2:
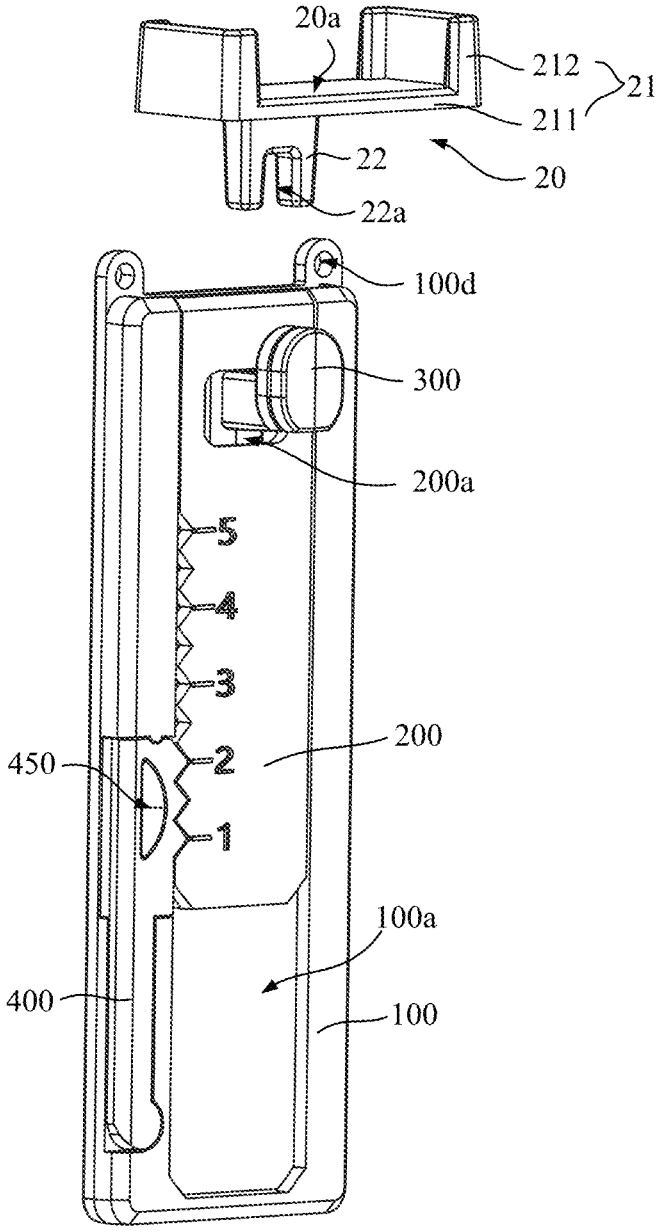
FIG. 2 is a structural schematic diagram of a wall mounting bracket and an assembly bracket being separated from each other.

In a second aspect, please refer to FIGS. 1-2, the present disclosure further provides a wall mounting device 1, including the wall mounting bracket 10 as foregoing and an assembly bracket 20. The assembly bracket 20 is detachably disposed on the mounting component 300, the assembly bracket 20 defines a mounting groove 20*a*, and the mounting groove 20*a* is configured to mount a level 30. Specifically, the assembly bracket 20 is disposed on the mounting portion 320, and then the level 30 is placed within the mounting groove 20*a*. The level 30 is configured to accurately measure a horizontal condition of the wall mounting bracket 10, so as to keep the wall mounting bracket in level during a mounting process, thereby preventing errors and deviations that could occur during the mounting process. After the wall mounting bracket 10 is mounted on the wall, the assembly bracket 20 is detached from the mounting portion 320, and the mounting portion 320 may mount the product. In addition, since the assembly bracket 20 and the mounting portion 320 are detachable, one assembly bracket 20 and one level 30 are capable of matching with a plurality of wall mounting brackets 10 for use, which saves materials and costs.

Figure 6:
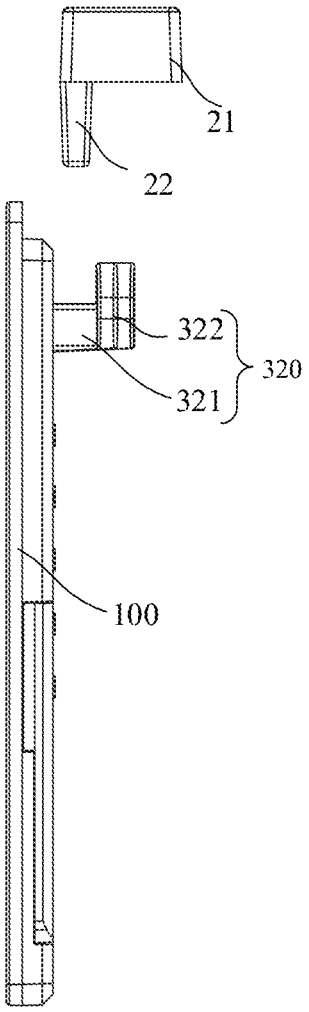
FIG. 6 is a side schematic diagram of the wall mounting bracket and the assembly bracket being separated from each other.
Figure 7:
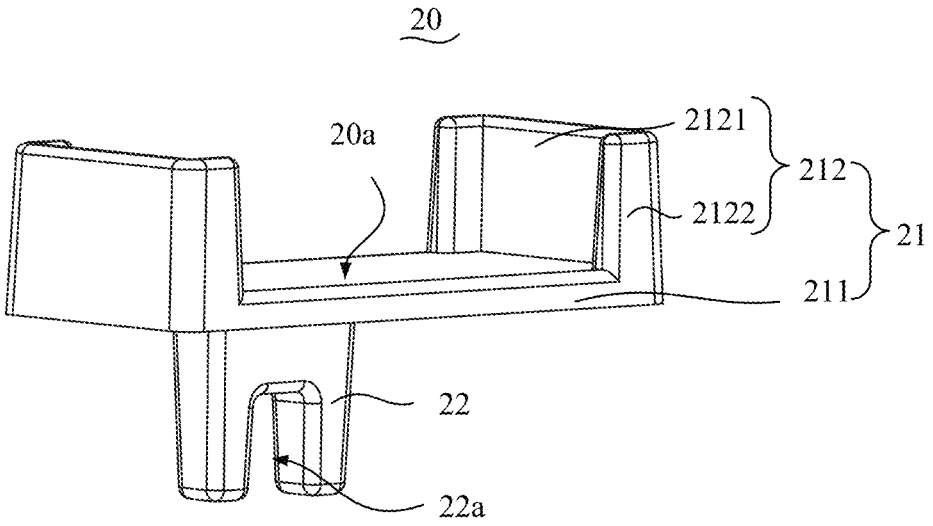
FIG. 7 is a structural schematic diagram of the assembly bracket according to one embodiment of the present disclosure.

Please refer to FIGS. 6-7, in some embodiments, the mounting portion 320 includes a mounting segment 321 and a limiting segment 322, the limiting segment 322 is connected to the mounting segment 321 and is disposed at an angle with the mounting segment 321. The assembly bracket 20 includes a bracket main body 21 and an assembly portion 22, the assembly portion 22 is connected to the bracket main body 21, the mounting groove 20*a* is defined on the bracket main body 21, the assembly portion 22 defines a fourth clamping groove 22*a* for the mounting segment 321 to insert into. In this way, mounting and dismounting of the assembly bracket 20 and the mounting portion 320 are simple, which is beneficial to mounting of the wall mounting bracket 10. It may be understood that the mounting segment 321 is configured to support the product, and the limiting segment 322 is configured limit the product to prevent the product from falling off from the mounting segment 321.

In some embodiments, the assembly bracket 20 includes a mounting plate 211 and two limiting baffles 212 at two sides thereof, the two limiting baffles 212 are respectively connected a top portion of the mounting plate 211, the two limiting baffles 212 and the mounting plate 211 cooperatively define the mounting groove 20*a*, in this way, the level 30 is prevented from accidental falling or damaging during a mounting process. Each of the two limiting baffles 212 includes an end plate 2121 and two side plates 2122, each two side plates 2122 are respectively disposed at a first side and a second side of a corresponding end plate 2121 and extend outward from a third side of the corresponding end plate 2121. Each two side plates 2122 are disposed opposite to each other, so as to cooperatively define the mounting groove 20*a* with the mounting plate 211. Corresponding two side plates 2122 of each limiting baffle 212 and corresponding two side plates 2122 of another limiting baffle 212 are spaced apart, so as to better observe a condition of the level 30 through gaps therebetween.

Same or similar reference numerals in the drawings of the embodiments of the present disclosure correspond to the same or similar components. In the description of the present disclosure, it should be understood that orientations or working position relationships indicated by terms "upper", "lower", "left", "right", etc. are only for ease of description of the present disclosure and simplified description, rather than indicating or implying that the referred device or element must have a specific orientation, and is constructed and operated in a specific orientation, so the terms describing the working position relationships in the accompanying drawings are only used for exemplary description and cannot be understood as a limitation to the present disclosure, and for those who skilled in the art, specific meanings of above terms may be understood according to specific situations.

The above are only preferred embodiments of the present disclosure and are not intended to limit the present disclosure, and any modification, equivalent replacement and improvement made within a spirit and a principle of the present disclosure shall fall within a protection scope of the present disclosure.

What is claimed is:

1. A wall mounting bracket, comprising:

a fixing component;

an adjusting component;

a mounting component; and at least one locking component;

wherein a first guiding groove is defined on the fixing component, a first side of the fixing component facing away from the first guiding groove is fixed to a mounting surface;

wherein the adjusting component is disposed in the first guiding groove and is slidable in the first guiding groove along a first direction, positioning grooves extending in the first direction are defined on at least one side of the adjusting component along the first direction;

wherein the mounting component is connected to the adjusting component and is configured to mount a product;

wherein at least one positioning protrusion extending in the first direction is disposed on one side of the at least one locking component, the at least one locking component is movably connected to the fixing component and has a locking state and an unlocking state;

wherein a limiting opening is defined on at least one groove side wall of the first guiding groove, when the at least one locking component is in the unlocking state, the adjusting component is slidable in the first guiding groove, when the at least one locking component is in the locking state, the at least one positioning protrusion passes through the limiting opening on the at least one groove side wall of the first guiding groove and is inserted into at least one of the positioning grooves to fix the adjusting component in the first guiding groove;

wherein the fixing component comprises a base plate, a first limiting structure, and a second limiting structure, the first limiting structure and the second limiting structure protrude from the base plate and are spaced apart in a direction perpendicular to the first direction;

the first limiting structure, the second limiting structure, and the base plate cooperatively define the first guiding groove;

one locking component is provided, one side of the first limiting structure facing away from the first guiding groove and the base plate cooperatively define a limiting groove, the limiting opening is defined on a middle portion of the first limiting structure, and the limiting opening is communicated with the first guiding groove and the limiting groove; and when the one locking component is in the locking state, the one locking component is disposed in the limiting groove.

2. The wall mounting bracket according to claim 1, wherein positioning protrusions are provided and are spaced apart along the first direction.

3. The wall mounting bracket according to claim 1, wherein the at least one locking component comprises a rotating connection portion and a locking portion, the rotating connection portion is connected to the locking portion, the rotating connection portion is rotatably connected to the fixing component, the at least one positioning protrusion is disposed on the locking portion; and when the at least one locking component is in the locking state, the at least one locking component is snap-fitted to the fixing component.

4. The wall mounting bracket according to claim 3, wherein the first limiting structure comprises a first connecting portion and a first limiting portion, the first connecting portion is connected to the base plate, the first limiting portion is connected to one end of the first connecting portion away from the base plate and is disposed at a first angle with the first connecting portion;

the first limiting portion, the first connecting portion, and the base plate cooperatively define a first clamping groove, the first clamping groove is communicated with the first guiding groove;

the second limiting structure comprises a second connecting portion and a second limiting portion, the second connecting portion is connected to the base plate, the second limiting portion is connected to one end of the second connecting portion away from the base plate and is disposed at a second angle with the second connecting portion;

the second limiting portion, the second connecting portion, and the base plate cooperatively define a second clamping groove, the second clamping groove is communicated with the first guiding groove; and two third limiting portions are respectively disposed at two opposite sides of the adjusting component, and the two third limiting portions are respectively slidably inserted into the first clamping groove and the second clamping groove.

5. The wall mounting bracket according to claim 4, wherein a rotating connection portion is rotatably connected to a bottom wall of the fixing component, the first limiting portion comprises a clamping protrusion in the limiting opening, the locking portion defines a third clamping groove at one end thereof away from the rotating connection portion for the clamping protrusion to insert into.

6. The wall mounting bracket according to claim 3, wherein a grasping groove is defined on the locking portion.

7. The wall mounting bracket according to claim 1, wherein identifiers are disposed on the adjusting component corresponding to the positioning grooves.

8. A wall mounting bracket, comprising:

a fixing component;

an adjusting component;

a mounting component; and at least one locking component;

wherein a first guiding groove is defined on the fixing component, a first side of the fixing component facing away from the first guiding groove is fixed to a mounting surface;

wherein the adjusting component is disposed in the first guiding groove and is slidable in the first guiding groove along a first direction, positioning grooves extending in the first direction are defined on at least one side of the adjusting component along the first direction;

wherein the mounting component is connected to the adjusting component and is configured to mount a product;

wherein at least one positioning protrusion extending in the first direction is disposed on one side of the at least one locking component, the at least one locking component is movably connected to the fixing component and has a locking state and an unlocking state;

wherein a limiting opening is defined on at least one groove side wall of the first guiding groove, when the at least one locking component is in the unlocking state, the adjusting component is slidable in the first guiding groove, when the at least one locking component is in the locking state, the at least one positioning protrusion passes through the limiting opening on the at least one groove side wall of the first guiding groove and is inserted into at least one of the positioning grooves to fix the adjusting component in the first guiding groove;

wherein a second guiding groove is defined on the adjusting component, the mounting component is disposed in the second guiding groove, the mounting component is slidable in the second guiding groove along a second direction, and the mounting component is fixed relative to the adjusting component after sliding; and the first direction is a horizontal direction, the second direction is a vertical direction, or, the first direction is the vertical direction, the second direction is the horizontal direction.

9. The wall mounting bracket according to claim 8, wherein the first direction is the vertical direction, and the second direction is the horizontal direction.

10. The wall mounting bracket according to claim 9, wherein the mounting component comprises a fixing portion and a mounting portion;

the fixing portion is disposed on a rear surface of the adjusting component; and the mounting portion is connected to a second side of the fixing component and passes through the second guiding groove to extend toward a front surface of the adjusting component.

11. The wall mounting bracket according to claim 10, wherein in a thickness direction of the adjusting component, the second guiding groove comprises a first groove body and a second groove body, the first groove body is communicated with the second groove body; and a size of the second groove body is larger than a size of the first groove body, the fixing portion is slidable in the second groove body, and the mounting portion is slidable in the first groove body.

12. The wall mounting bracket according to 11, wherein the fixing portion is plate-shaped, and a groove depth of the second groove body is adapted to a thickness of the fixing portion.

13. The wall mounting bracket according to claim 11, wherein the fixing portion defines at least one concave groove, the adjusting component comprises at least one protruding rib disposed in the second groove body, the at least one protruding rib is clamped in the at least one concave groove.

14. The wall mounting bracket according to claim 13, wherein the adjusting component comprises a first plate body and a second plate body, the first plate body and the second plate body are stacked, the first groove body is defined on the first plate body, the second groove body is defined on the second plate body, and the at least one protruding rib is further disposed on the second plate body.

15. The wall mounting bracket according to claim 13, wherein two protruding ribs are provided and disposed at two opposite sides of the first groove body in the second direction.

16. The wall mounting bracket according to claim 8, wherein at least one mounting hole is defined on the fixing component, at least one fastening component passes through the at least one mounting hole and is fixed to the mounting surface, so as to fix the fixing component on the mounting surface; and/or the wall mounting bracket further comprises a double-sided adhesive layer disposed on a rear surface of the fixing component, the double-sided adhesive is configured to bond the fixing component to the mounting surface.

17. A wall mounting device, comprises:

the wall mounting bracket according to claim 1; and an assembly bracket;

wherein the assembly bracket is detachably disposed on the mounting component, the assembly bracket defines a mounting groove, and the mounting groove is configured to mount a level.

18. The wall mounting device according to claim 17, wherein the mounting component comprises a fixing portion and a mounting portion;

the mounting portion comprises a mounting segment and a limiting segment, the mounting segment is connected to a second side of the fixing portion, the limiting segment is connected to one end of the mounting segment away from the fixing portion and is disposed at an angle with the mounting segment; and the assembly bracket comprises a bracket main body and an assembly portion, the assembly portion is connected to the bracket main body, the mounting groove is defined on the bracket main body, the assembly portion defines a fourth clamping groove for the mounting segment to insert into.

19. The wall mounting device according to claim 18, wherein the bracket main body comprises a mounting plate and two limiting baffles at two sides thereof, the two limiting baffles are respectively connected to a top portion of the mounting plate, each of the two limiting baffles comprises an end plate and two side plates, each two side plates are respectively disposed at a first side and a second side of a corresponding end plate and extend outward from a third side of the corresponding end plate;

each two side plates are disposed opposite to each other, so as to cooperatively define the mounting groove with the mounting plate.

20. A wall mounting bracket, comprising:

a fixing component;

an adjusting component;

a mounting component; and at least one locking component;

wherein a first guiding groove is defined on the fixing component, a first side of the fixing component facing away from the first guiding groove is fixed to a mounting surface;

wherein the adjusting component is disposed in the first guiding groove and is slidable in the first guiding groove along a first direction, positioning grooves extending in the first direction are defined on at least one side of the adjusting component along the first direction;

wherein the mounting component is connected to the adjusting component and is configured to mount a product;

wherein at least one positioning protrusion extending in the first direction is disposed on one side of the at least one locking component, the at least one locking component is movably connected to the fixing component and has a locking state and an unlocking state;

wherein a limiting opening is defined on at least one groove side wall of the first guiding groove, when the at least one locking component is in the unlocking state, the adjusting component is slidable in the first guiding groove, when the at least one locking component is in the locking state, the at least one positioning protrusion passes through the limiting opening on the at least one groove side wall of the first guiding groove and is inserted into at least one of the positioning grooves to fix the adjusting component in the first guiding groove;

wherein the at least one locking component comprises a rotating connection portion and a locking portion, the rotating connection portion is connected to the locking portion, the rotating connection portion is rotatably connected to the fixing component, the at least one positioning protrusion is disposed on the locking portion, and when the at least one locking component is in the locking state, the at least one locking component is snap-fitted to the fixing component;

wherein a grasping groove is defined on the locking portion.

* * * * *